US005450004A

United States Patent [19]

Ikeda

[11] Patent Number: 5,450,004

[45] Date of Patent: Sep. 12, 1995

[54] VOLTAGE GENERATING DEVICE

[75] Inventor: Masaharu Ikeda, Yokohama, Japan

[73] Assignee: Matsushita Electric Industrial Co., Ltd., Osaka, Japan

[21] Appl. No.: 219,417

[22] Filed: Mar. 29, 1994

Related U.S. Application Data

[63] Continuation of Ser. No. 963,700, Oct. 20, 1992, abandoned.

[30] Foreign Application Priority Data

Oct. 21, 1991 [JP] Japan ..... 3-272274

[51] Int. Cl.[6] ..... G05F 3/20

[52] U.S. Cl. ..... 323/313; 323/907

[58] Field of Search ..... 323/311, 312, 313, 314, 323/315, 907

[56] References Cited

U.S. PATENT DOCUMENTS

| | | | |
|---|---|---|---|
| 3,956,661 | 5/1976 | Sakamoto et al. | 307/297 |
| 4,459,540 | 7/1984 | Hayashi | 323/314 |
| 4,473,793 | 9/1984 | Blackmer et al. | 323/311 |
| 4,490,669 | 12/1984 | Wilhelm | 323/313 |
| 4,658,205 | 4/1987 | Yamada | 323/313 |
| 5,013,999 | 5/1991 | Yamada | 323/313 |
| 5,168,210 | 12/1992 | Thus | 323/313 |

FOREIGN PATENT DOCUMENTS

| | | | |
|---|---|---|---|
| 0379092A1 | 7/1990 | European Pat. Off. . | |
| 0191626 | 10/1984 | Japan | 323/313 |
| 60-191508 | 9/1985 | Japan . | |
| 63-177214 | 7/1988 | Japan . | |
| 2193410 | 7/1990 | Japan . | |
| 1025433 | 10/1966 | U.S.S.R. | 323/907 |

*Primary Examiner*—Peter S. Wong
*Assistant Examiner*—Adolf Berhane
*Attorney, Agent, or Firm*—Stevens, Davis, Miller & Mosher

[57] ABSTRACT

A voltage generating device is capable of generating a voltage which does not depend upon temperature even if a power source voltage is not higher than 1.25 V. The device comprises an output terminal thereof, current sources, resistors and a diode like connected transistor. A voltage on the output terminal is obtained by causing a current to flow through series-connected resistors. The current sources are band gap current sources. The current source is assumed as opened. A part of the diode like connected transistor is represented by an equivalent circuit including a voltage source and a resistor. The equivalent circuit and the resistors are represented by an equivalent circuit by using the Thevenin's theorem.

21 Claims, 2 Drawing Sheets

VOLTAGE GENERATING DEVICE

This application is a continuation of application Ser. No. 07/963,700, filed Oct. 20, 1992 (abandoned).

CROSS-REFERENCE TO RELATED APPLICATION

This application relates to U.S. Ser. No. 07/963,752, filed Oct. 20, 1992, entitled "Amplifier" being filed by Masaharu Ikeda, and assigned to the present assignee, based on Japanese Application No. 3-272276 filed Oct. 21, 1991 and the contents of which are incorporated herein by reference.

BACKGROUND OF THE INVENTION

1. Field of the Invention

The present invention relates to a voltage generating device which generates a voltage which does not depending upon the temperature.

2. Description of the Prior Art

Such type of prior art voltage generating devices comprises a voltage source including a semiconductor PN junction for generating a voltage which negatively changes with temperature and a voltage source for generating a thermal voltage (kT/q) which positively changes with temperature, both voltage sources being connected in series for cancelling the changes in voltage with temperature with each other.

The structure of a prior art voltage generating device is shown in FIG. 1. In FIG. 1, a reference numeral 1 denotes an output terminal of a voltage generating device; 21 denotes a current source; 22 a resistor; 23 a diode-like connected transistor. A voltage on the output terminal 1 is obtained by causing a current to flow from the current source 21 through the series-connected resistor 22 and diode 23. The current source, 21 is a band gap current source as disclosed in JP-A-60-191508. The current value Ics is determined by equation (1).

$$Ics=(k\times T/q)\times ln(N)\times Rcs \quad (1)$$

wherein k denotes the Boltzmann's constant; T denotes an absolute temperature; q denotes the charge of electrons; N denotes a constant; Rcs denotes a current presetting resistance.

The voltage Vo on the output terminal 1 can be expressed by equation (2).

$$Vo=Vf23+R22\times Ics \quad (2)$$

wherein Vf23 and R22 denote the forward voltage of the transistor 23 and the resistance of the resistor 22, respectively.

The first clause in equation (2) denotes the forward voltage of the diode-like connected transistor 23. It is generally well known that this voltage changes at −2 mV/deg with temperature when it is about 650 mV. Therefore, a change in voltage with temperature in the second clause is preset to a value which has the opposite sign, and is equal to the absolute value of that in the first clause thus, the changes in voltage with temperature in the first and second clauses can be cancelled with each other. Briefly, in order to make Vo a temperature independent voltage, equation (2) is put into the second clause to provide equation (3).

$$\begin{aligned} R22\times Ics &= R22\times(k\times T/q)\times \ln(N)/Rcs \\ &= (k\times T/q)\times \ln(N)\times R22/Rcs \end{aligned} \quad (3)$$

A change in voltage with temperature is obtained by differentiating equation (3) with respect to the absolute temperature T. If the change is represented by +2 mV, equation (4) is obtained.

$$\begin{aligned} d(R22\times Ics)/dT &= (k/q)\ln(N)\times R22/Rcs \\ &= +2\text{ mV} \end{aligned} \quad (4)$$

By putting equation (4) into equation 3 and by setting the thermal coefficients of R22 and Rcs equal to each other and T=300 K, equation (5) is obtained.

$$\begin{aligned} R22\times Ics &= d(R22\times Ics)/dT\times T \\ &= +2\text{ mV}\times 300^\circ\text{ K.} = 600\text{ mV} \end{aligned} \quad (5)$$

Accordingly, if R22 or Ics is preset in such a manner that R22×Ics=600 mV, Vo is determined as about 1.25 V in accordance with equation (2). Vo is independent of temperature. This approach has been widely adopted since the thermal coefficients of R22 and Rcs can be easily made equal if these components are formed on a single semiconductor chip.

In such a manner, even the prior art voltage generating device is capable of generating a voltage which is independent of temperature.

However, the prior art voltage generating device can not be used for a circuit which requires a power source voltage which is lower than 1.25 V since the voltage which is independent of temperature only down to voltage of 1.25 V. In other words, since the first clause in equation (2) is fixed as 650 mV, the second clause should be equal or lower than 600 mV. Accordingly, Vo is dependent upon temperature for values below 1.25 V.

SUMMARY OF THE INVENTION

The present invention aims at solving the above mentioned problems of the prior art. It is therefore an object of the present invention to provide an excellent voltage generating device which is capable of providing a voltage which is independent of temperature even if a power source voltage is not greater than 1.25 V.

In order to accomplish the above mentioned object, the present invention provides a voltage generating device comprising: a diode; biasing means for generating a forward voltage across the diode; voltage dividing means for dividing the forward voltage which is generated by the biasing means; and current generating means for causing a current to flow through a divided voltage output of the voltage dividing means; wherein a voltage which is independent of temperature can be obtained even if the power source voltage is equal to or less than 1.25 V.

In order to accomplish the above mentioned object, the present invention further provides a voltage generating device comprising: a diode; voltage dividing means for dividing a terminal voltage across the diode; and current generating means for causing a current to flow through a divided voltage output of the voltage dividing means; wherein a voltage which is independent of temperature can be obtained even if a power source voltage is equal to or less than 1.25 V.

Accordingly, in accordance with the former invention, the forward voltage which negatively changes with the temperature which is obtained by causing the forward current to flow through the diode from the biasing means is divided by the voltage dividing means and a voltage which positively changes with temperature is properly superposed upon the divided forward voltage by the current generating means and the voltage dividing means. Thus, a voltage which is independent of temperature can be obtained even if the power source voltage is equal to or less than 1.25 V.

If the output voltage Vo is preset equal to or less than 0.7 V and the current generating means is formed of a low voltage operating type source, as is disclosed in JP-A-60-191508, the power source voltage can be lowered to 0.9 V and the device can be easily formed of a semiconductor integrated circuit.

Accordingly, in accordance with the latter invention, the forward voltage, which negatively changes with the temperature which is obtained by causing a forward current to flow through the diode and the voltage dividing means from the current generating means, is divided by the voltage dividing means and a voltage which positively changes with temperature is properly superposed upon the divided forward voltage by the current generating means and the voltage dividing means.

Thus, a voltage which is independent of temperature can be obtained even if the power source voltage is equal to or less than 1.25 V.

If the current generating means is formed of a low voltage operating type source, as is disclosed in JP-A-60-191508, the power source voltage can be lowered to the output voltage Vo to about 0.2 V and the device can be easily formed of a semiconductor integrated circuit.

DESCRIPTION OF THE PREFERRED EMBODIMENT

Figure 2A:
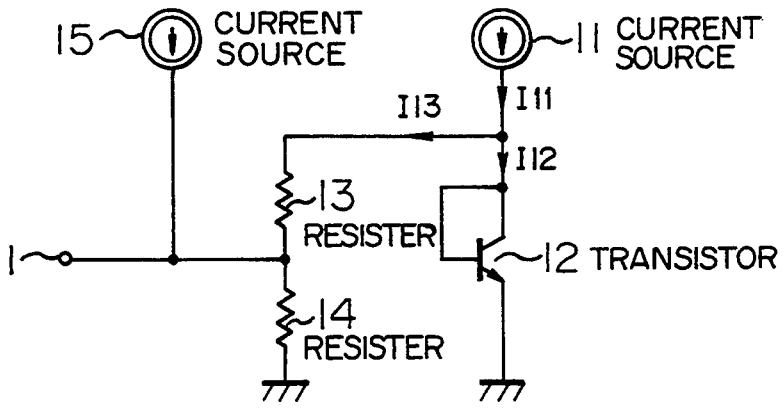
FIG. 2A is a circuit diagram showing a first embodiment of a voltage generating device of the present invention.
Figure 2B:
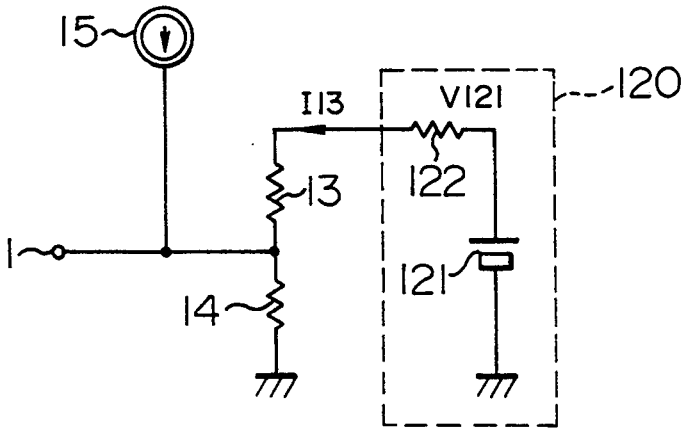
FIG. 2B is an equivalent circuit diagram showing a part of the device of FIG. 2A, including a current source and a transistor.
Figure 2C:
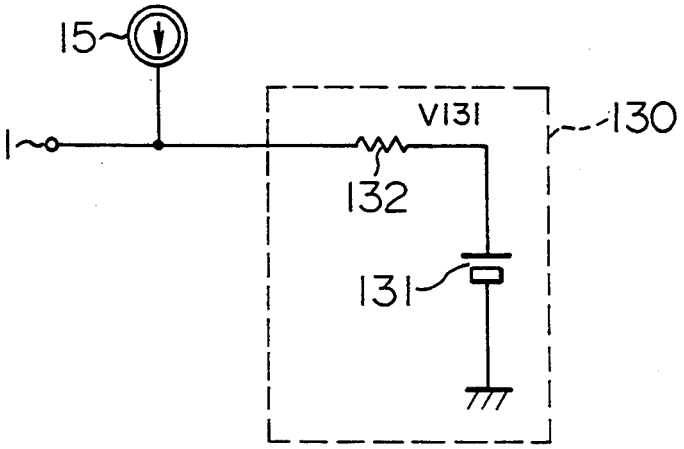
FIG. 2C is an equivalent circuit diagram showing a part of the device of FIG. 2A, including the current sources, the transistor and resistors.

Referring now to FIGS. 2A to 2C, there is shown the structure of a first embodiment of the present invention.

In FIG. 2A, a reference numeral 1 denotes an output terminal of a voltage generating device; 11 and 15 denote current sources; 13 and 14 denote resistors; 12 denotes a diode-like connected transistor (i.e. a semiconductor device having a PN junction). A voltage on the output terminal 1 is obtained by causing a current to flow through series-connected resistors 13 and 14. The current sources 11 and 15 are formed of current Miller circuits and the like, using a band gap current source disclosed in JP-A-60-191508.

The operation of the embodiment of FIG. 2A will be described with reference to FIGS. 2B and 2C.

Since there are two signal sources in the embodiment of FIG. 2A, the operation will be described by using the principle of superposition. The current source 15 is assumed as opened. In FIG. 2B, the diode-like connected transistor or diode 12 is represented by an equivalent circuit 120 including a voltage source 121 and a resistor 122. The value V121 of the voltage sources 121 and the value R122 of the resistor 122 are expressed by equations (6) and (7), respectively.

$$V121 = Vf12 \tag{6}$$

$$R122 = (k \times T/q)/I12 \tag{7}$$

wherein Vf12 and I12 denote the forward voltage of the transistor 12 and the collector current of the transistor 12, respectively.

In FIG. 2C, the equivalent circuit 120 and the resistors 13 and 14 are represented by an equivalent circuit 130 by using Thevenin's theorem. The value of V131 of the voltage source 131 and the value R132 of the resistor 132 are represented by equations (8) and (9).

$$V131 = Vf12 \times R14/(R13 + R122 + R14) \tag{8}$$

$$R132 = (R13 + R122) \times R14/(R13 + R122 + R14) \tag{9}$$

wherein R13 and R14 denote the resistances of the resistors 13 and 14, respectively. The current source 15 will be considered. A current Ics from the current source 15 is also defined by the equation (1). Since the current I15 from the current source 15 flows into the voltage source I31 through the resistor 132, an output voltage Vo on the output terminal 1 can be expressed by equation (10).

$$Vo = V131 + R132 \times I15$$

$$Vo = M \times \{Vf12 + (k \times T/q) \times ln(N) \times (R13 + R122)/Rcs\} \tag{10}$$

wherein $$M = R14/(R13 + R122 + R14).$$

Equation (10) resembles equation 2 of the prior art. The output voltage Vo which is independent of the temperature can be generated by an approach similar to the prior art. In other words, the first clause in the parenthesis { } in equation (10) denotes the forward voltage of the diode-like connected transistor and is about 650 mV. Since this forward voltage changes at −2 mV/degree with respect to temperature, the changes in voltage with the temperatures in the first and second clauses are cancelled with each other if the R13 and Rcs are preset so that the change in voltage relative to the temperature in the second clause in the parenthesis { } is +2 mV/deg. This value is the same as the value of equation (5). Accordingly, the output voltage Vo can be finally made independent of temperature and the level of the voltage Vo can be desiredly preset by presetting M. If the output voltage is preset to, for example, 0.5 V, M is preset to 0.5 V/1.25 V. The values R13, R14, I11 and I15 of the resistors 13 and 14 and the current sources 11 and 15 can be determined in accordance with equations 6 to 10.

If R122 is sufficiently lower than R13, Vo is represented by the ratio of R13, R14 and the resistor Rcs which determines the current from the current source 15, so that designing of the circuit can be made easier.

Since a voltage having a level which is a product of an absolute temperature T which is obtained from the resistors 13 and 14 and the current source 15 and a coefficient such as resistance ratio which is independent of temperature is superposed upon the forward voltage which is obtained by the diode-like connected transistor 12 and the current source 11 in equation (10), in accordance with the first embodiment of the present invention, the output voltage can be preset so as to cancel the changes in the output voltage with temperature, similarly as in the prior art and the level of the output voltage can be easily preset with a constant M. The voltage on the output terminal of the current source 11 will not become equal to or greater than the forward voltage of the diode. If the voltage Vo is preset equal to or lower than the forward voltage of the diode and a low voltage operative current source, which is disclosed in JP-A-60-191508 is used, a power source can be used having a lowered to about 0.9 V.

Since the values of the resistors 13 and 14 which are related with the output voltage define a ratio, the present device can be easily formed of an semiconductor integrated circuit independently of the accuracy of the absolute values of the resistors.

The characteristics relative to temperature can be determined by (R13+R122)/Rcs in accordance with equation (10) and thus does not depend upon R14. There is an advantage that the voltage Vo can be desiredly determined.

While the forward voltage which is obtained from the current source 11 and the diode-like connected transistor 12 is applied to a voltage divider including resistors 13 and 14 without passing through other components, it may be applied to the voltage divider via a buffer amplifier (not shown). In this case, design of the device is made easier since R122 becomes sufficiently lower.

While components are preset in the first embodiment so that the output voltage Vo does not depend upon temperature, they may be preset to provide the device with a desired temperature characteristic.

Figure 1:
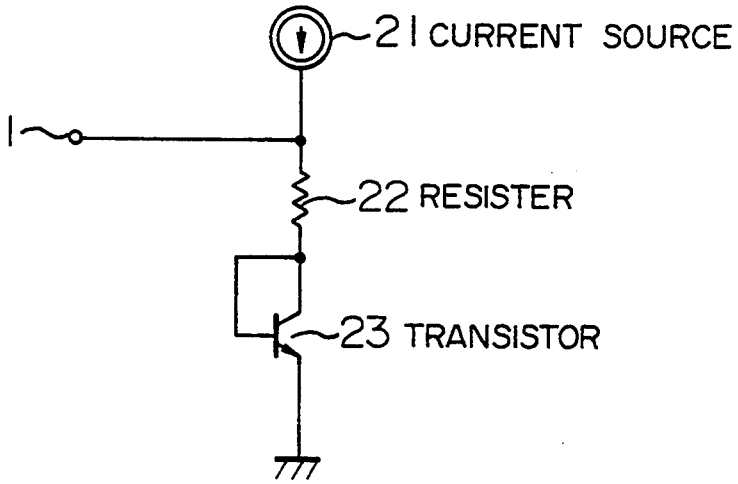
FIG. 1 PRIOR ART
FIG. 1 is a circuit diagram showing a prior art voltage generating device.
Figure 3:
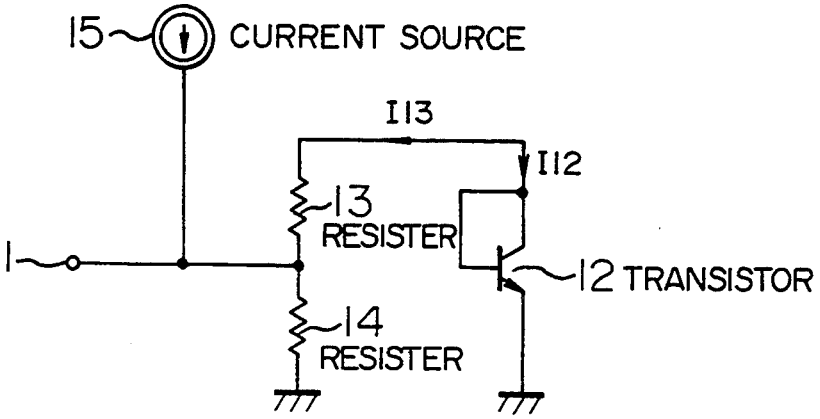
FIG. 3 is a circuit diagram showing a second embodiment of a voltage generating device of the present invention.

Referring now to FIG. 3, there is shown the structure of a second embodiment of the present invention, reference numeral 1 denotes an output terminal of a voltage generating device; 15 denotes a current source; 13 and 14 denote resistors; and 12 denotes a diode-like connected transistor (i.e. a semiconductor device having a PN junction). A voltage on the output terminal 1 is obtained by causing a current to flow from the current source 15 through the series-connected resistors 13 and 14. The current source 15 is made of a Miller circuit or the like, using a band gap current source as is disclosed in JP-A-60-191508. The second embodiment of the present embodiment is substantially identical with the first embodiment except that the current source 11 in the first embodiment is omitted. The second embodiment is effective in cases where the voltage Vo on the output terminal 1 is higher than the forward voltage of the transistor 12. In this case, the current I13 flowing through the resistor 13 will flow in an opposite direction so that a bias current can be caused to flow through the transistor 12 even if no current Ill flows from the current source 11.

Since a voltage, having a level which is a product of an absolute temperature T obtained from the resistors 13 and 14 and the current source 15 and a coefficient, such as a resistance ratio, which is independent of temperature is superposed upon the forward voltage obtained by the diode-like connected transistor 12 and the current source 11 in equation 10 in accordance with the second embodiment of the present invention, the output voltage can be preset so as to cancel the changes in the output voltage with temperature similarly to the prior art and the level of the output voltage can be easily present with a constant M. The voltage on the output terminal of the current source 11 will not become equal to or higher than the forward voltage of the diode. If a low voltage operative current source, as is disclosed in JP-A-60-191508, is used a power source can be used with the voltage Vo lowered to about +0.2 V.

Since the values of the resistors 13 and 14, which are related with the output voltage, define a ratio, the present device can be easily formed of an semiconductor integrated circuit independently of the accuracy of the absolute values of the resistors.

The characteristics of the device with respect to temperature can be determined by (R13+R122)/Rcs in accordance with equation (10) and thus does not depend upon R14. There is an advantage that the value of the voltage Vo can be desiredly determined.

While components are preset in the second embodiment so that the output voltage Vo does not depend upon temperature, they may be preset to provide the device with a desired temperature characteristic.

As is apparent from the foregoing, the first embodiment of the present invention is formed so that a voltage having a level which is proportional to an absolute temperature obtained from the voltage dividing means, including a plurality of resistors and current sources, is superposed upon the forward voltage which is obtained by a current source for biasing a diode-like connected transistor in a forward direction. The superposed voltage can be preset so as to cancel the changes in voltage with temperature. As a result, a voltage output which does not depend upon temperature can be obtained. The level of the output voltage can be easily preset by a voltage dividing ratio of the voltage dividing means.

Since the voltage on the terminal of the current source will not become equal to or higher than the forward voltage of the diode if the output voltage Vo is preset not higher than the forward voltage of the diode, the power source voltage can be lowered to about 0.9 V.

Since the values of the resistors which determine the output voltage are represented by a ratio, the device can be easily formed of a semiconductor integrated circuit independently of the accuracy of the absolute values.

As is apparent from the foregoing, the second embodiment is formed so that a voltage having a level which is proportional to an absolute temperature T obtained from voltage dividing means including a plurality of resistors; and a current source is superposed upon the-forward voltage which negatively changes with temperature obtained by causing a forward current through a diode via a voltage dividing means from current generating means, the superposed voltage is preset so as to cancel changes in voltage with temperature. Accordingly, a voltage output which does not depend upon temperature can be obtained. The level of the output voltage can be easily preset by a voltage dividing ratio of voltage dividing means.

The power source voltage can be used until the output voltage Vo is lowered to about +0.2 V.

Since the values of the resistors which determine the output voltage can be represented by a ratio, the device can be easily formed of a semiconductor integrated circuit independently of the accuracy of the absolute values.

I claim:

1. A voltage generating device comprising:

a semiconductor device having a PN junction;

biasing means for generating a forward voltage, subject to a negative temperature coefficient, across the PN junction of the semiconductor device;

voltage dividing means, comprising at least two resistors connected across said PN junction of the semiconductor device, for dividing the forward voltage which is generated across the PN junction of the semiconductor device;

an output terminal connected to a junction point of said at least two resistors of the voltage dividing means; and current generating means for supplying current, subject to a positive temperature coefficient, directly to the junction point of the at least two resistors of the voltage dividing means;

wherein:

a divided output voltage of the forward voltage, subject to the negative temperature coefficient, appears on one of the at least two resistors, said divided output voltage being compensated for by superposing a voltage, subject to the positive temperature coefficient, developed on the one of the at least two resistors due to the current supplied from the current generating means on the divided output voltage, to thereby produce a resulting output voltage; and (i) a magnitude of the resulting output voltage and (ii) said temperature coefficients may be easily set.

2. A voltage generating device as defined in claim 1, wherein the current generated by the current generating means is proportional to an absolute temperature and is controlled to a value which is inversely proportional to a current presetting resistance.

3. A voltage generating device as defined in claim 1, wherein the current generated by the current generating means is proportional to an absolute temperature and is controlled to a value which is inversely proportional to a current presetting resistor, and the thermal coefficient of the current presetting resistor is equal to that of the voltage dividing resistor.

4. A voltage generating device as defined in claim 1, wherein said biasing means comprises a current generator.

5. A voltage generating device as defined in claim 4, wherein said biasing means and said current source generating means comprise low power supply voltage-type current sources.

6. A voltage generating device as defined in claim 1, wherein said biasing means and said current source generating means comprise low power supply voltage-type current sources.

7. A voltage generating device as defined in claim 1, wherein said PN junction of the semiconductor device is forward-biased.

8. A voltage generating device as defined in claim 7, wherein said semiconductor device comprises a cathode connected to ground.

9. A voltage generating device as defined in claim 8, wherein said semiconductor device further comprises an anode connected to said biasing means.

10. A voltage generating device as defined in claim 1, wherein said semiconductor device comprises a cathode connected to ground.

11. A voltage generating device as defined in claim 1, further comprising an output terminal connected directly to said voltage dividing means.

12. A voltage generating device comprising:

a a semiconductor device having a PN function;

voltage dividing means, comprising at least two resistors connected across said PN junction of the semiconductor device, for dividing a terminal voltage across the PN junction of the semiconductor device;

an output terminal connected to a junction point of said at least two resistors of the voltage dividing means; and current generating means for supplying a current, subject to a positive temperature coefficient, directly to the junction point of the at least two resistors, said current flowing, in part, through the PN junction of the semiconductor device so as to generate a forward voltage, subject to a negative temperature coefficient, as the terminal voltage of the semiconductor device so as to forward bias said PN junction of the semiconductor device;

wherein:

a divided output voltage of the forward voltage, subject to the negative temperature coefficient, appears on one of the at least two resistors, said divided output voltage being compensated for by a voltage, subject to the positive temperature coefficient, developed on said one of the two resistors due to the current supplied from the current generating means superposed on the divided output voltage, to thereby produce a resulting output voltage; and (i) a magnitude of the resulting output voltage and (ii) said temperature coefficients may be easily set.

13. A voltage generating device as defined in claim 12, wherein the current generated by the current generating means is proportional to an absolute temperature and is controlled to a value which is inversely proportional to a current presetting resistance.

14. A voltage generating device as defined in claim 12, wherein the current generated by the current generating means is proportional to an absolute temperature and is controlled to a value which is inversely proportional to a current presetting resistor, and the thermal coefficient of the current presetting resistor is equal to that of the voltage dividing resistor.

15. A voltage generating device as defined in claim 12, wherein said current generating means comprises a low power supply voltage-type current source.

16. A voltage generating device as defined in claim 12, wherein said semiconductor device comprises a cathode connected to ground.

17. A voltage generating device as defined in claim 16, wherein said semiconductor device further comprises an anode connected to said voltage dividing means.

18. A voltage generating device as defined in claim 17, further comprising an output terminal connected directly to said voltage dividing means.

19. A voltage generating device as defined in claim 16, further comprising an output terminal connected directly to said voltage dividing means.

20. A voltage generating device as defined in claim 12, further comprising an output terminal connected directly to said voltage dividing means.

21. A voltage generating device as defined in claim 1, wherein said divided output voltage corresponds to a forward voltage, subject to the negative temperature coefficient, obtained by (i) said PN junction of the semiconductor device and (ii) said biasing means superposed by a voltage, subject to the positive temperature coefficient, having a value equal to a current supplied from said current generating means multiplied by an equivalent resistance as viewed from the junction point of said voltage dividing means and said semiconductor device.

* * * * *